United States Patent [19]

Elwin

[11] 3,988,962

[45] Nov. 2, 1976

[54] LOADING PENDULUM

[75] Inventor: Tore Elwin, Karlskoga, Sweden

[73] Assignee: AB Bofors, Bofors, Sweden

[22] Filed: Dec. 2, 1974

[21] Appl. No.: 528,615

[30] Foreign Application Priority Data

Dec. 5, 1973 Sweden ..... 7316391

[52] U.S. Cl. ..... 89/46; 89/47

[51] Int. Cl.[2] ..... F41H 7/06

[58] Field of Search ..... 89/33 A, 33 B, 45, 46, 89/47

[56] References Cited

UNITED STATES PATENTS

| | | | |
|---|---|---|---|
| 1,185,249 | 5/1916 | Seeberger | 89/46 |
| 1,753,850 | 4/1930 | Courseulles | 89/45 |
| 3,146,671 | 9/1964 | Girouard et al. | 89/47 |
| 3,884,119 | 5/1975 | Zouck | 89/45 |

FOREIGN PATENTS OR APPLICATIONS

| | | | |
|---|---|---|---|
| 380,350 | 8/1909 | France | 89/47 |

*Primary Examiner*—Stephen C. Bentley
*Attorney, Agent, or Firm*—Pollock, Vande Sande & Priddy

[57] ABSTRACT

Apparatus for the loading of rounds of ammunition from a magazine into the barrel of a firearm, particularly a firearm supported on a tank. The firearm is movable in elevation about a first axis, and a pendulum-like member is provided which is rotatable about a second axis parallel to the axis about which the barrel rotates. The pendulum-like member is also movable translationally along the axis about which it rotates. Apparatus is provided for rotating the pendulum-like member about the axis of rotation between first and second angular positions, and further apparatus is provided for translationally moving the pendulum-like member along its rotational axis between predetermined spaced locations. To transfer a round of ammunition to the pendulum-like member from a magazine, the member is translationally moved along the axis and also rotated about the axis so as to be disposed adjacent the magazine, thereby making possible the transfer of an ammunition round into the member. Thereafter, the member is rotated about its axis of rotation and also moved along the axis so as to place the round in position where it can readily be rammed into the breach of the firearm barrel.

9 Claims, 15 Drawing Figures

Snitt A---A

LOADING PENDULUM

The present invention relates to a loading pendulum that can be used in a firearm, particularly in a tank.

BACKGROUND OF THE INVENTION

It is a pronounced requirement that a tank shall have a low silhouette, while at the same time its supply of ammunition should be carried low down in the tank. There is also a desire that a tank shall be able to carry ammunition of various types, in order to be able to combat targets of different kinds. However, this involves special requirements, not only as to the loading pendulum used, but also as to the arrangement of the loading pendulum in the tank.

SUMMARY OF THE INVENTION

The present invention is primarily intended to solve the above-mentioned problems, and provides for the use of a loading pendulum which, in principle, is rotatably supported at its rear parts and into which the round in question is fed with the cartridge case end first. The loading pendulum in its filling position is then directed obliquely downwards/forwards, so that the round can be swung to the ramming position from below in relation to the breech ring of the firearm.

A principal feature of the loading pendulum of the invention is that it is also arranged to be rotatable in a plane through the center line of the firearm between a first angular position in which a round is fed to the pendulum and a second angular position for ramming of said round in the firearm and so that it is movable laterally in relation to the plane extending through the center line of the firearm.

The invention also becomes advantageous for a tank with an unsymmetrically mounted barrel, i.e., one having the center line of the barrel parallel to the longitudinal center line of the tank, as the loading pendulum can then be utilized with two magazines of different sizes.

BRIEF DESCRIPTION OF THE DRAWING

An embodiment proposed at present which shows the characteristics significant for the invention will be described in the following with reference to the attached drawings, in which.

DETAILED DESCRIPTION OF THE PREFERRED EMBODIMENT

Figure 1:
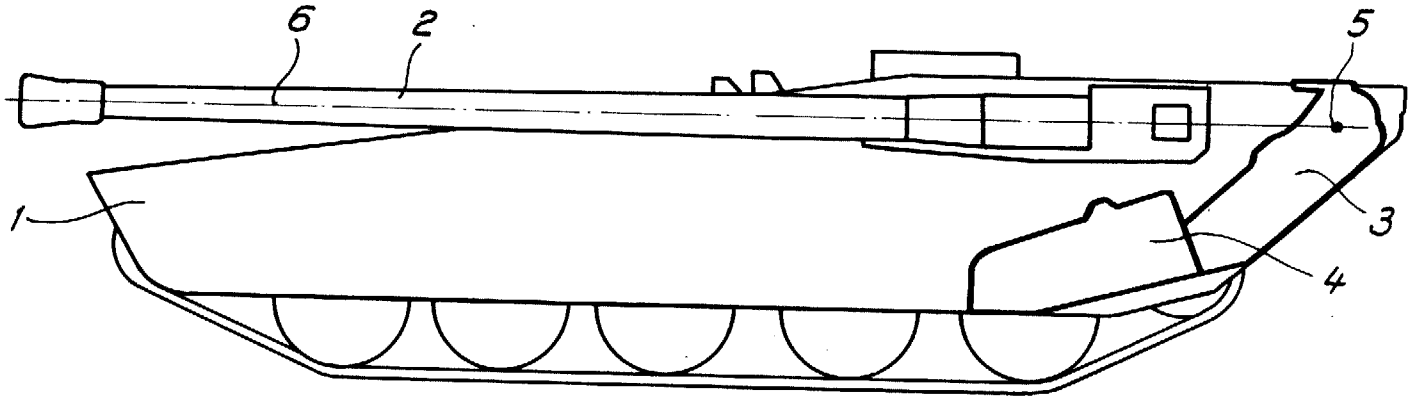
FIG. 1 in a vertical view shows a tank utilizing the invention.

FIG. 1 shows a representative tank, in which the invention can be used. The tank is of the kind in which the barrel of the firearm is arranged so that it can be elevated around a trunnion center at the rear parts of the barrel, the elevation then being achieved by means of hydraulic pistons, not shown, which actuate the barrel at its central parts. Traversing of the barrel is achieved by traversing the entire tank.

In FIG. 1, the tank is designated 1, and its barrel is designated 2. The space for the loading pendulum in question is designated 3, while the magazine is designated 4. The loading pendulum is rotatably arranged in a support 5 in a plane through the center line 6 of the barrel between a first angular position, where a round from the magazine in question can be fed into the pendulum with the cartridge case end first, and a second turning position, where the round which was fed to the pendulum can be rammed in the firearm. The support 5 for the pendulum coincides with the trunnion center of the barrel.

Figure 2:
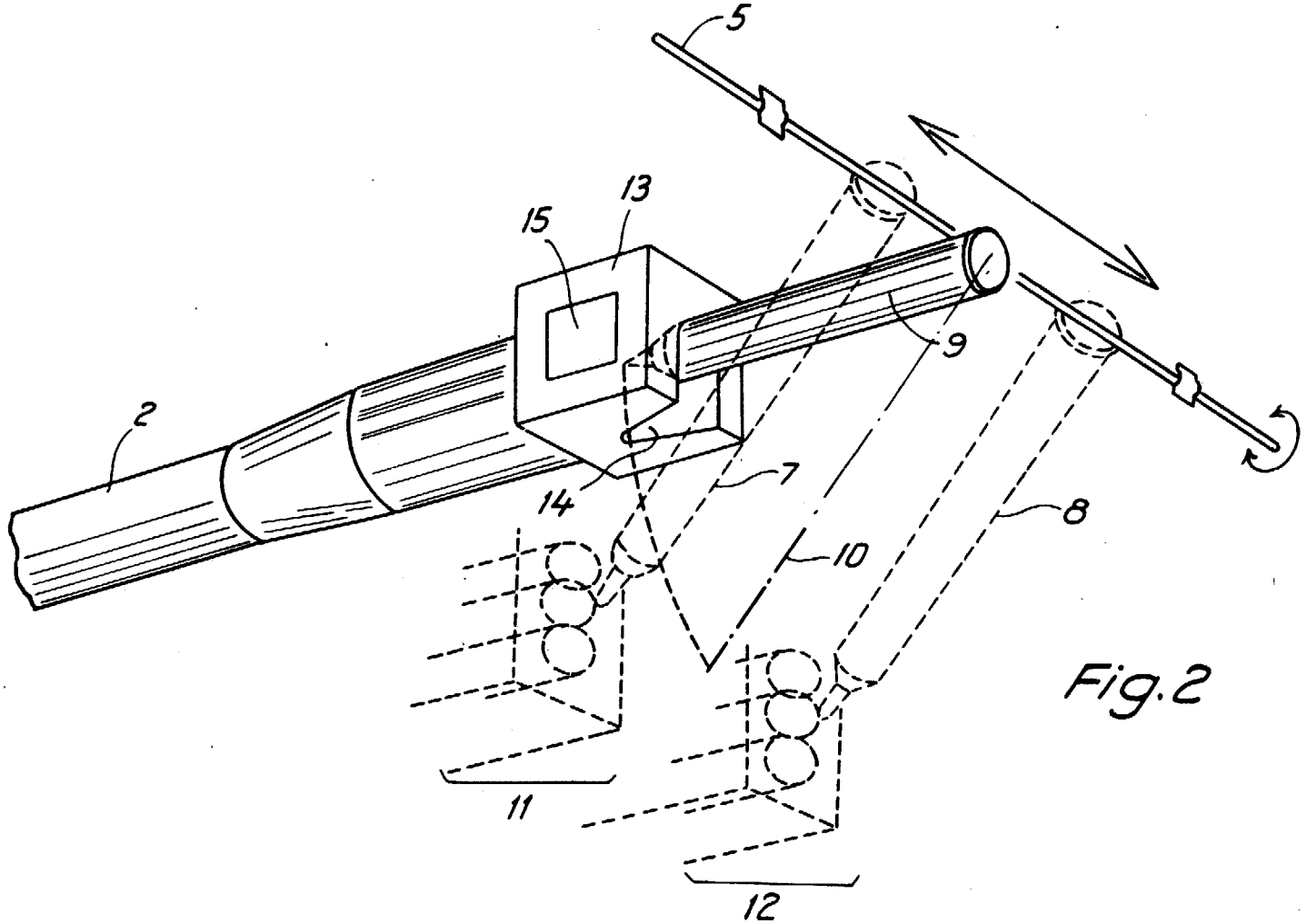
FIG. 2 in perspective shows the functioning principle of the new loading pendulum.

FIG. 2 shows the principle of the mode of operation of the pendulum according to the present invention. In the drawing, for the sake of clarity, the actual loading pendulum has not been shown, but only the round which is fed up by means of the pendulum, which supports the round with the cartridge case end at its rear parts. The loading pendulum assumes a first angular position, which is shown with the two rounds 7 and 8 indicated by dash lines, and a second angular position which is shown with the round 9 indicated with solid lines. In the first angular position, the pendulum can be moved laterally from a central position shown by a dot-dash line 10, to two side positions, the round 7 then assuming one of the side positions and the round 8 assuming the other side position. The respective side positions are distinct, and in one of the side positions the pendulum has its front part at the magazine 11 and in the other side position the pendulum has its front part at the magazine 12. In FIG. 2, the respective magazines are represented with three rounds which are stacked upon each other. It is then assumed that the magazines comprise more rounds, stacked in columns at the side of the respective columns formed by the three rounds in each magazine.

The use of double magazines gives advantages in various respects, among other things inasmuch as the tank can use different magazines for different kinds of ammunition. Moreover, the ammunition can be advantageously distributed within the space available in the tank. In the present case, the rounds in the respective magazines are arranged in rows and columns, each column then containing three rounds, as shown in FIG. 2.

In accordance with FIG. 2, the loading pendulum is assumed to be supported around the support 5 at its rear parts, and the pendulum, when it transfers a round from the first angular position gives the round a swinging movement in which the point is the part of the round that carries out the greatest swinging movement. The breech ring 13 of the barrel is then made with a recess 14, directed downwards-rearwards, which is open downwards when a breech block 15, not shown in detail in the figure, is in its opened position. The round can then be swung by the pendulum from below in relation to the barrel so that the point of the round enters into the breech ring via the recess 14.

The loading pendulum is moreover arranged in such a way that, in the first angular position, it goes to the central position before it is swung up towards the breech ring. In the example of the embodiment, said central position is located exactly half way between the two side positions.

Figure 3:
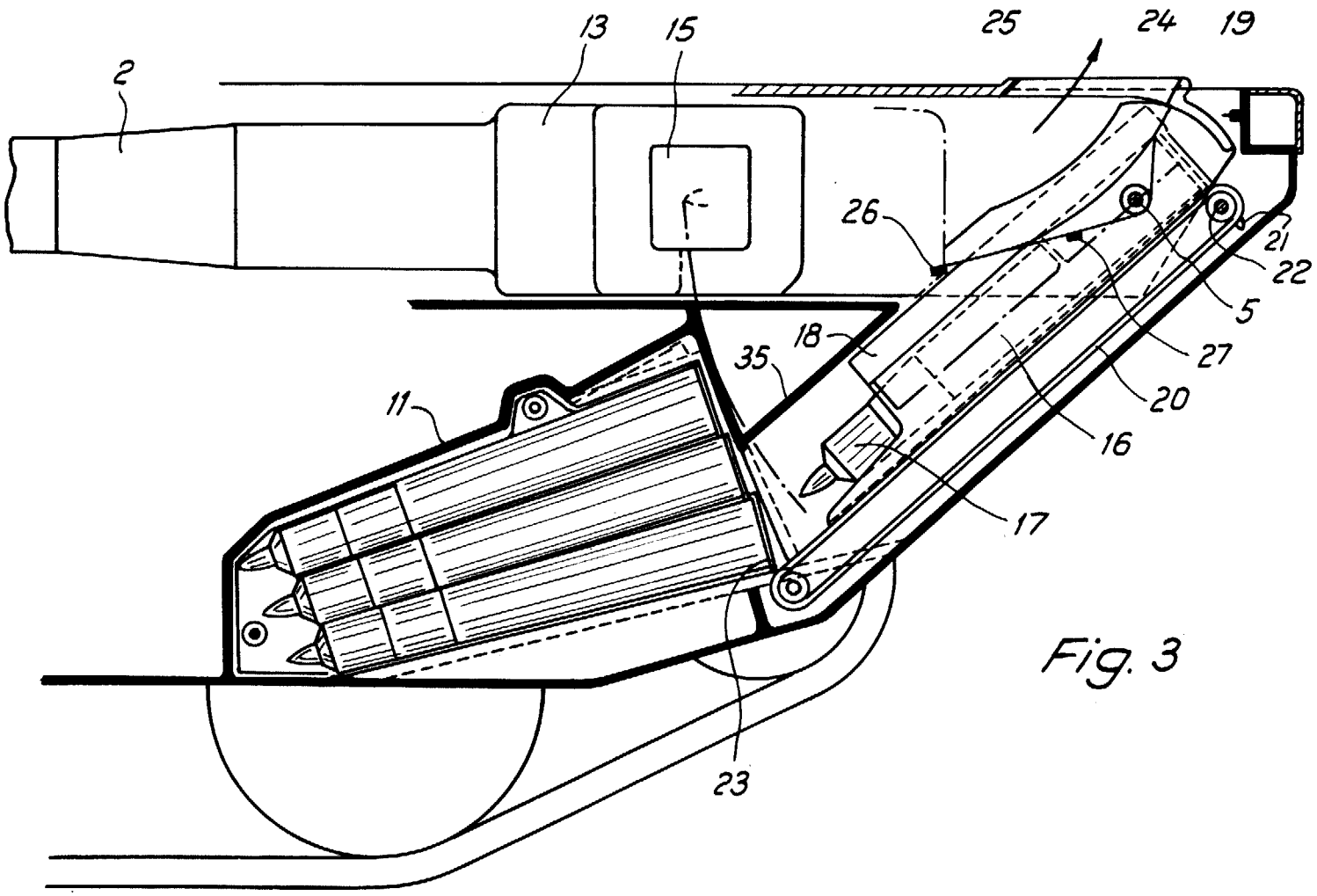
FIG. 3 in a vertical view shows a first embodiment of the loading pendulum.

In FIG. 3, a first design of a loading pendulum is illustrated. The loading pendulum is shown in its first angular position and in its side position where its front part is located in front of the magazine 11. A round 17 has been fed into the pendulum with its cartridge case end first. On its upper side, the loading pendulum supports a rammer 18, which has a cleat 19 that coacts with the rear end of the round fed to the loading pendulum, and by means of which the rammer is cocked by the round during the feeding. Said feeding takes place by means of an endless chain 20 or the like that supports a carrier stud 21. The chain is driven from a shaft 22 which in turn is driven by a motor with gear transmission, not shown in detail. In the magazine in question, the round is placed so that the rear end 23 of the lowermost round projects outside the middle round, the rear end of which, in turn, projects outside the rear edge of the uppermost round. The chain 20 is then arranged to the rear end of the lowermost round so that the carrier stud 21 can engage same when the chain is driven and pull up the lowermost round into the pendulum. When the lowermost round has been pulled out, any round lying on top of it will fall down so that, in a subsequent stage, the carrier stud can coact with the rear edge of this, etc. The carrier stud coacts with the rear edge of the round via a longitudinal slot in the under side of the pendulum. Each side position (magazine) is equipped with its endless chain and carrier stud, and the two chains can appropriately be arranged so that they can be driven by one and the same motor and gear transmission.

On both sides of the pendulum, on the supporting shaft 5, cartridge case deflectors 24 are supported, which deflect cartridge cases ejected from the barrel through an opening 25 in the tank. The angular position of the cartridge case deflectors on the shaft is dependent on the elevation of the barrel, and the angle to which the loading pendulum is turned. The angular positions of the cartridge case deflectors are determined by means of two lugs, 26 and 27, arranged on the pendulum and the barrel, respectively. The lug 26 then determines the position of the cartridge case deflector when the pendulum is in the first turning position and the lug 27 moves the cartridge case deflectors out of the way, so that these will not be in the way when the pendulum swings up. In this connection, it may be mentioned that the cartridge case deflection function always takes place when the loading pendulum is in the first angular position.

Figure 4:
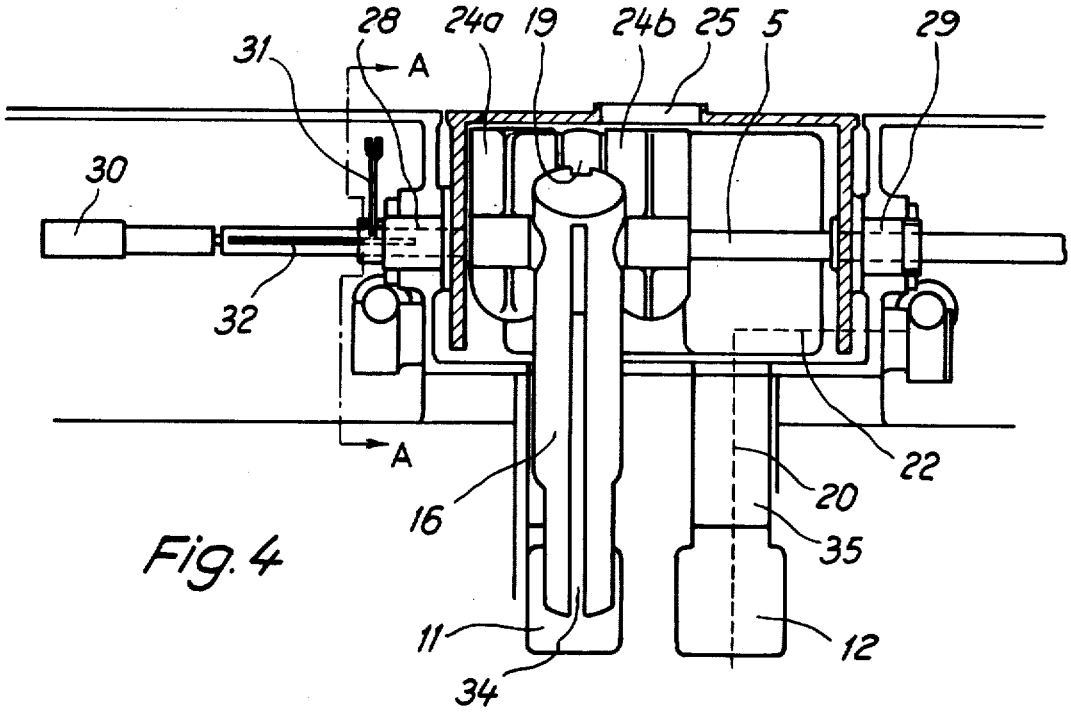
FIG. 4 in an end view shows the loading pendulum according to FIG. 3, viewed from the rear, FIG. 5 in a vertical view shows a detail of the pendulum.
Figure 5:
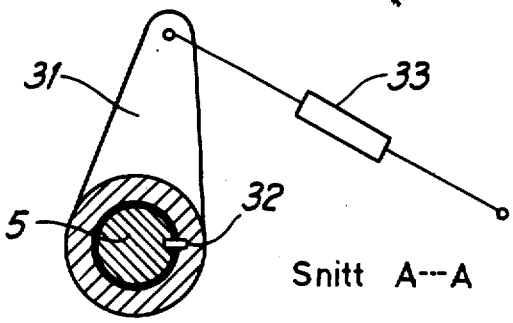

FIG. 4 shows the pendulum according to FIG. 3 from the rear. The pendulum 16 is fixed to a shaft 5, and therefore this shaft is displaceable in its longitudinal direction, and rotatable in accordance with FIG. 2. The displacement in the longitudinal direction is achieved by the shaft 5 being displaceably arranged in this direction in two bearing brackets 28 and 29. The displacement is achieved by means of an actuating member in the form of a hydraulic piston 30, which is arranged at one end of the supporting shaft. The turning movement of the shaft is achieved by means of an angle arm 31, through which the supporting shaft is also displaceably supported in its longitudinal direction, while the shaft and angle arm are connected with each other via a longitudinal key 32, which transfers the angular movement to the shaft. In accordance with FIG. 5, this angular movement of the shaft is achieved with the aid of an actuating member in the form of a hydraulic piston 33. Said actuating members 30 and 33 can be controlled in a way known in itself, in order to obtain the two angular positions, as well as the two distinct side positions and the central position of the pendulum. The pistons 30 and 33 can be of the same kind as the piston 50 described in the following.

FIG. 4 shows the longitudinal slot, designated 34, on the under side of the pendulum, and the respective filling position also has an obliquely positioned counter-support surface 35 for the pendulum. It will also be noted that when the pendulum is set in one of the filling positions (i.e., the position according to the figure) the cartridge case deflector **24*b* will be exactly opposite the axis of the bore and the opening 25. When the pendulum is in the second side position, the cartridge case deflector 24*a*** functions in the corresponding way.

Figure 6:
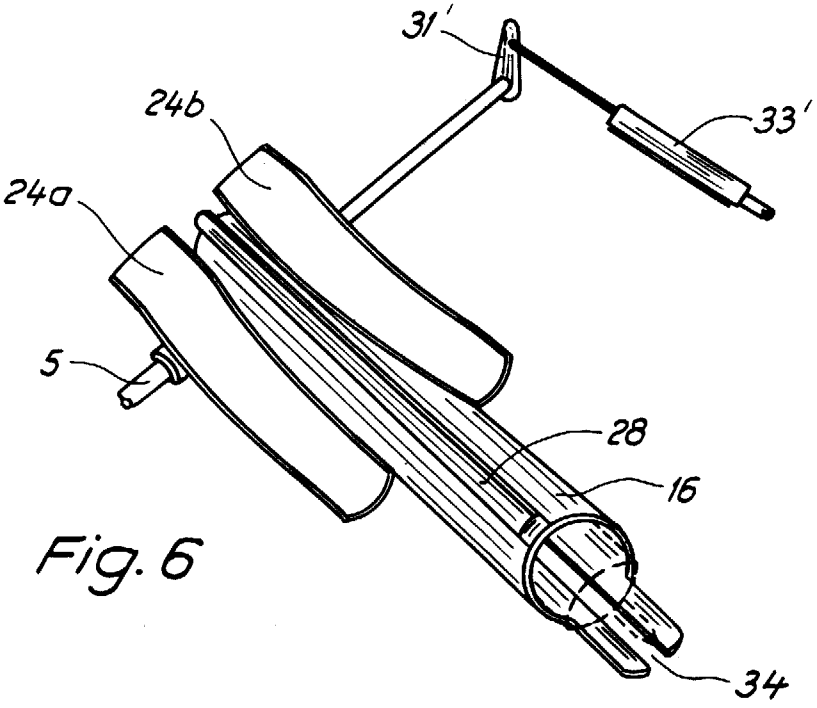
FIG. 6 in perspective, viewed obliquely from above; shows part of the pendulum according to FIG. 4, FIG. 7 in a vertical view, shows a second embodiment of the loading pendulum.

The respective cartridge case deflector has a concave deflection surface, as shown in FIG. 6, which deflection surface is designed to give the most appropriate cartridge case deflection in each and every design case of the tank. The front edge of the cartridge case deflector will be at the rear surface of the breech ring during the cartridge case deflection function when the recoil has moved the barrel rearwards to a position shown in FIG. 3. The loading pendulum itself is designed with an essentially circular cross-section, and at its front parts with a fork-like section. In FIG. 4, the chain 20 and the driving shaft 22 for the chain are shown with dash lines, the driving shaft then being actively connected with a motor, not shown in the figure, via a gear transmission belonging to same.

Figure 7:
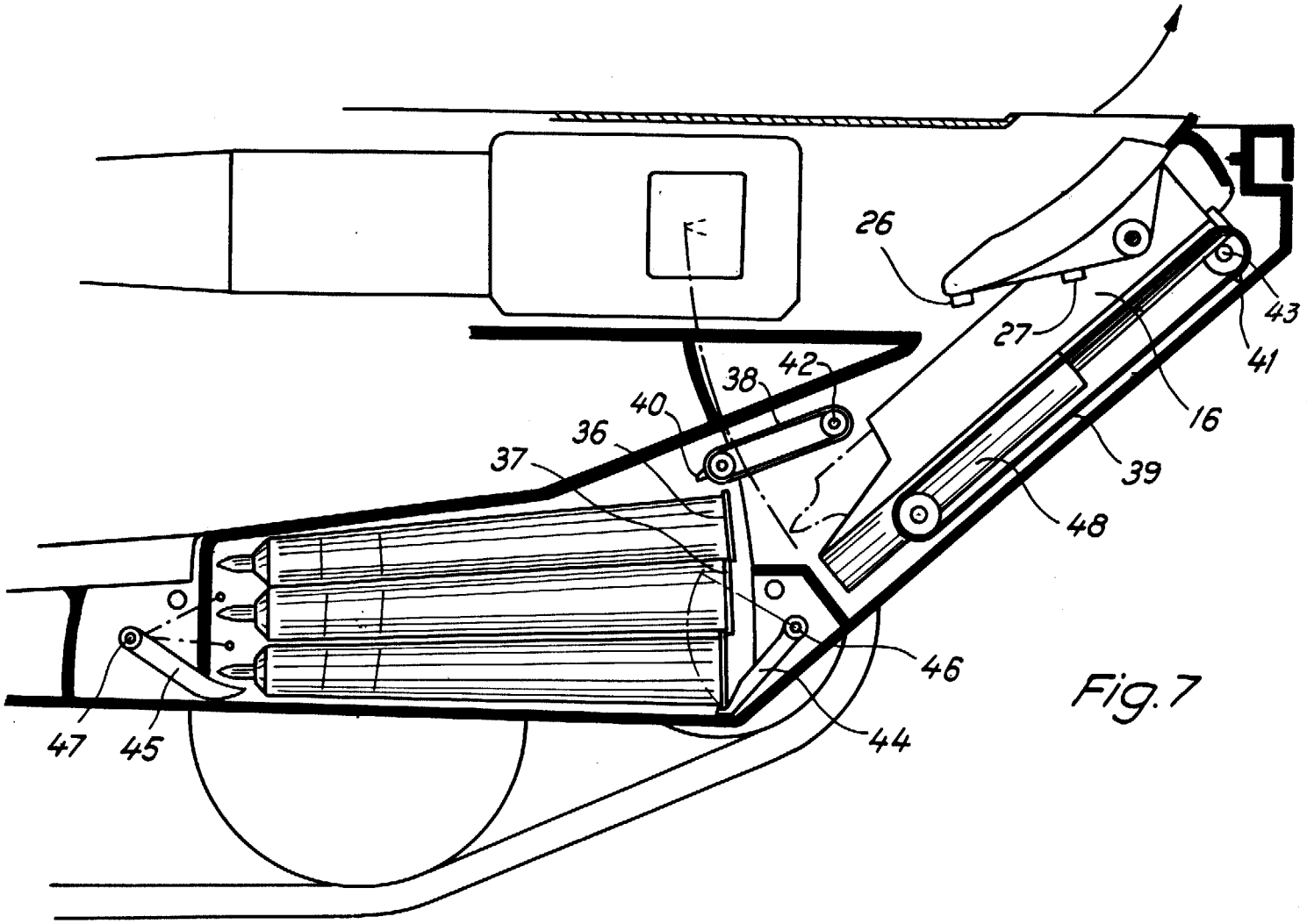

FIG. 7 shows an embodiment in which the uppermost round in the respective column is fed into the pendulum 16. The rounds are then stacked in such a way that the rear edge 36 of the uppermost round is outside the rear edge 37 of the middle round, etc.

In this case, two endless chains, 38 and 39, with their carrier studs 40 and 41, respectively, are used which chains and carrier studs are duplicated for the two side positions. Double driving equipment is also used inasmuch as the chains 38 for the two side positions are driven separately via the shaft 42 and the chains 39 in the two side positions are driven separately via the shaft 43. However, it is also possible to utilize the same driving motor and gear transmission for the two driving shafts.

In this case, one of the chains, 38, moves the round to a position in the pendulum where the other 39 can take over and pull up the round to its final position in the pendulum. In order that subsequent rounds may be fed after the uppermost round has been pulled out of the magazine, the remaining rounds must be raised up so that coaction with the carrier stud on chain 38 can be achieved. This raising is carried out by means of lifting arms 44 and 45, which are supported on supporting shafts 46 and 47, respectively, and which are actuated by means of a two-stage hydraulic piston which, in turn, can be controlled in a way which is known in itself, by means of hydraulic valves, not shown. The raising of the rounds can take place by means of lifting arms at both end of the rounds, but is preferably carried out only at the cartridge case end, as a more advantageous inclination is then obtained for the rounds when they are to be fed into the pendulum.

In this case, the pendulum supports a rammer 48 on its under side, beside the longitudinal slot for the carrier stud 41 on the endless chain 39.

Figure 8A:
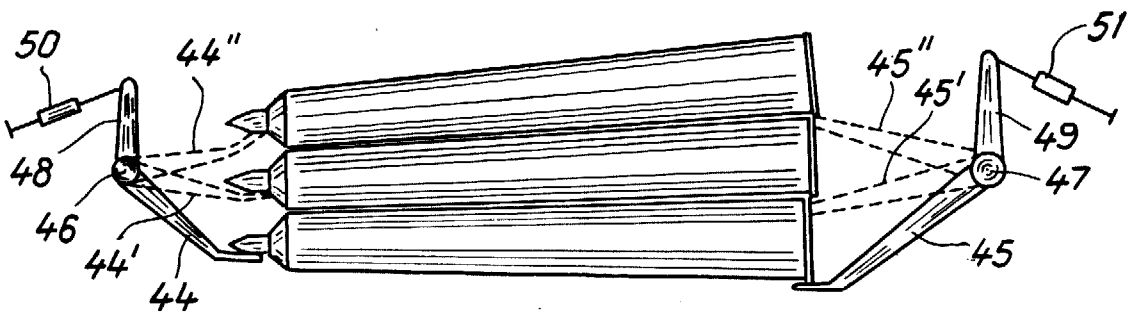
FIG. 8*a* in a vertical view shows a detail of FIG. 7.
Figure 8B:
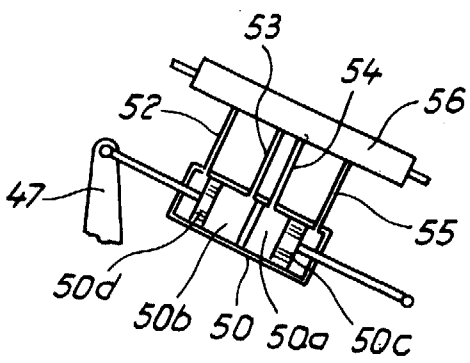
FIG. 8*b* in a vertical view shows a detail of FIG. 8*a* in an enlargement.

FIG. 8*a* shows the lifting arms in somewhat more detail, the lifting positions then being illustrated by 44', 44'' and 45', 45'' respectively. Angle arms 48 and 49 are also mounted on the shafts, for the turning of the shaft. The actuation of the shafts via said angle arms takes place by means of hydraulic pistons 50 and 51, respectively. The principle of the respective two-stage hydraulic piston is shown in FIG. 8*b*, which shows the piston 50. The piston is provided with two chambers, 50*a* and 50*b*, and two pistons 50*c* and 50*d*, which are positioned in the respective chambers. The piston is provided with four operating conductors 52–55, by means of which three positions can be achieved. In the first position, the pistons have been given the position shown in the figure. In the second position of the piston, the piston 50*c* has been moved to the wall between the chambers, and in the third position also the second piston 50*d* has been moved towards said wall. The pressures in said operating conductors are controlled by means of a pilot valve 56, which is known in itself.

In accordance with the above, the piston 50 is also representative for the piston 20, which determines the lateral displacement of the pendulum, and the hydraulic piston shown in FIG. 8*b* is entirely applicable to the piston 30 if the reference designation 50 in FIG. 8*b* is changed to the reference designation 30. In the pendulum position according to FIG. 4, both pistons of the hydraulic piston are moved to the wall separating the chambers; in the central position of the pendulum, one of the pistons has been actuated to its outer position; and in the other side position, both of the pistons of the hydraulic piston have been actuated to their outer positions. In this case, said pilot valve 56 has been modified in order to achieve the specific pattern of movement for the pendulum.

The above-mentioned piston 33 for achieving the two angular positions of the pendulum need only be provided with one chamber, one piston, and two operating conductors, once on each side of the plunger.

A method of placing a round in the ramming position for a firearm consists of, in principle, that the loading pendulum is directed with the front part pointing downwards and particularly obliquely forwards towards a filling position for the loading pendulum, that the round is fed into the pendulum via its front part with the cartridge case end first and that thereafter the pendulum is swung about an axis normal to the pendulum's axis so that, the forward point of the round is given the greatest swinging movement. The concept of the invention also involves that the pendulum, after the round has been fed into it, is given a lateral displacement from the filling position before it is turned to the ramming position. In case several rounds are stacked upon each other in a magazine at the filling positions, the lowermost or the uppermost round is fed into the pendulum by means of one or several endless chains or the like which respectively support a carrier stud which coacts with a protruding edge on the cartridge case of the round.

Figure 9:
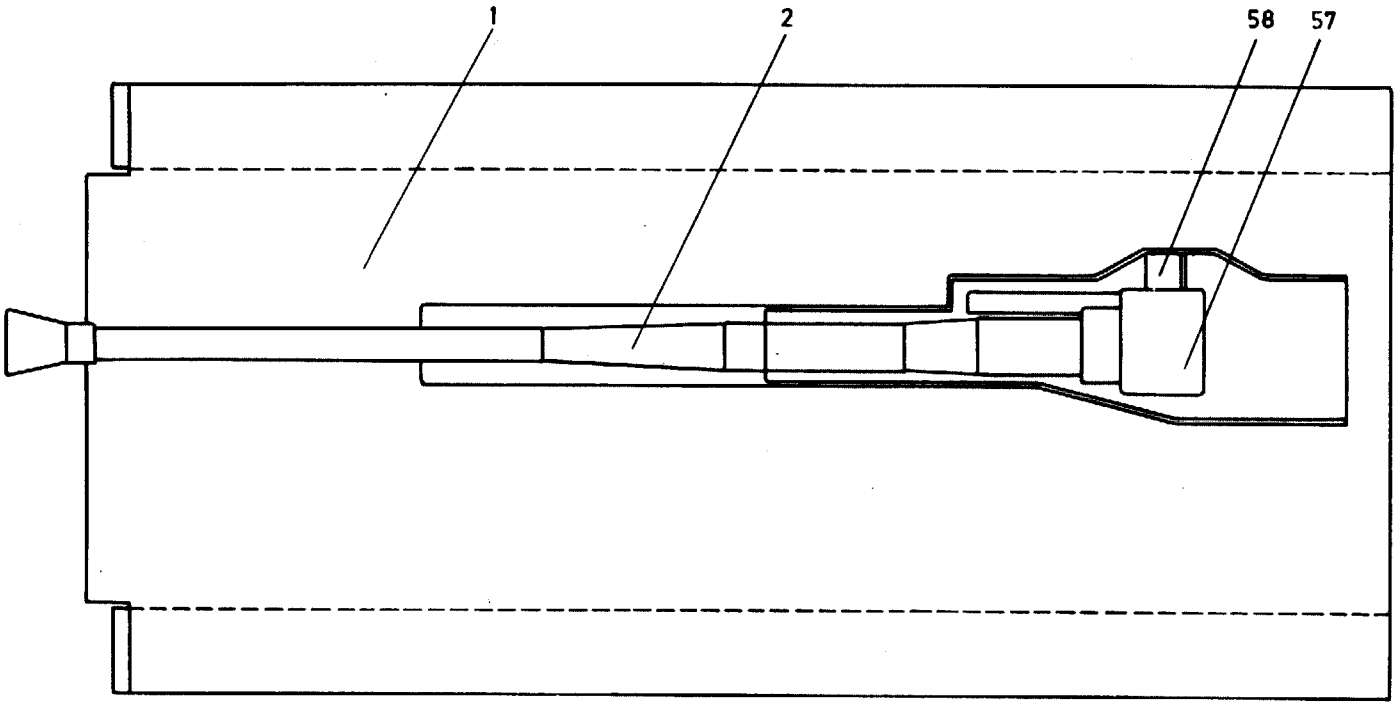
FIG. 9 in a horizontal view shows the tank according to FIG. 1.

In FIGS. 1 and 9 which show the tank 1 and the firearm 2, the breech ring of the weapon is designated as 57 and a breech block in the breech ring is designated as 58. The weapon is supported so that it can be elevated on a trunnion at the breech ring, and the actual elevation is carried out by means of a hydraulic piston, not shown, which coacts with the center portion of the barrel. Traversing takes place in a way which is known in itself, by turning the entire vehicle laterally.

Figure 10:
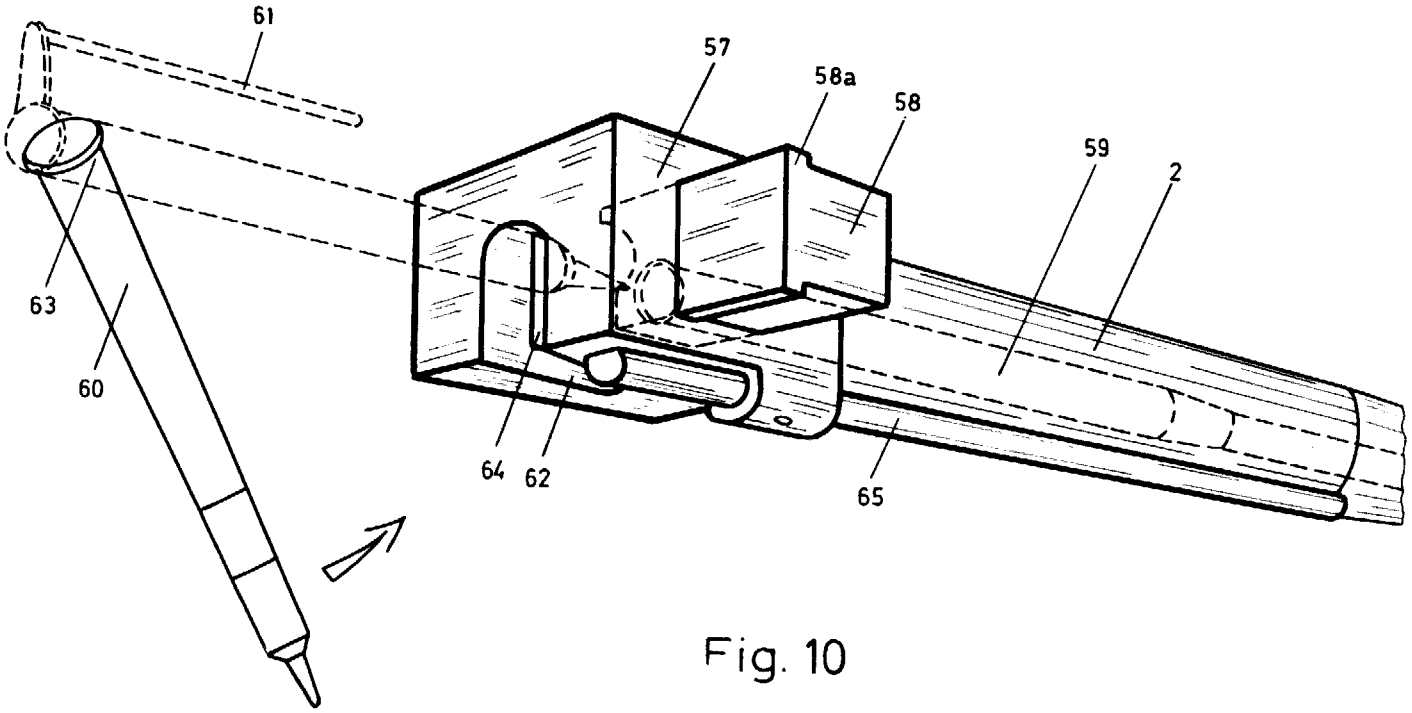
FIG. 10 in perspective, obliquely from below, shows the firearm according to FIGS. 1 and 9 in more detail.

In FIG. 10, the breech block is shown in its open (extracted) position, where the bore 59 in the gun is open so that the round 60 can be rammed by means of the rammer 61 belonging to the other parts of the system. The rammer can be of a kind known in itself and does not concern the actual invention, and it is therefore shown symbolically only.

In accordance with FIG. 10, the breech ring is made with, inter alia, flat bottom and side surfaces. It is moreover provided with a recess 62 which cuts into the breech ring in such a way that it emerges into the rear surface of the breech ring, as well as in its under surface. The breech block 58 is also provided with a recess which, when the breech block is in its open position (i.e., the position according to FIG. 10) conforms to the recess 62 of the breech ring, so that the latter will be open downwards. The recess 62 and the recess in the breech block are moreover made in such a way that in said open position of the breech block they are adapted to the front parts (the point) of the round, so that upon movement of the round towards the ramming position, these front parts can enter into the breech ring from below, and can be rammed into the bore 59 in accordance with FIG. 10. A loading pendulum which saves space horizontally can then be utilized at the breech ring, which upon the ramming of the round, in principle swings this around on a supporting shaft 63 which is located in the extension of the center line of the barrel.

Furthermore, in FIG. 10, the groove for the breech block 58 is designated 64, which groove in the example of the embodiment is arranged transversally in a horizontal direction in order to permit horizontal displacement of the breech block. The groove 64 has a form corresponding to that of the breech block, and at its rear section the breech block is provided with special guide rails 58*a*, in a way which is known in itself.

By means of the embodiment shown, the breech ring will be able to receive the round (its front parts) from a direction which is substantially at right angles to the direction of movement of the breech block.

In FIG. 10, a protective cylinder for a mechanism for operating the breech block is designated as 65, which protective cylinder is also shown in FIG. 9. The mechanism itself does not concern the actual invention, and can consist of a conventional breech block mechanism of automatic or semi-automatic type.

When the round has been rammed into the bore, the mechanism operates the breech block so that this assumes a closed position, and blocks behind the round. When the round has been fired, the mechanism causes the breech block to return to its open position, the cartridge case is removed, and a new round can be inserted in the bore, etc.

Figure 11A:
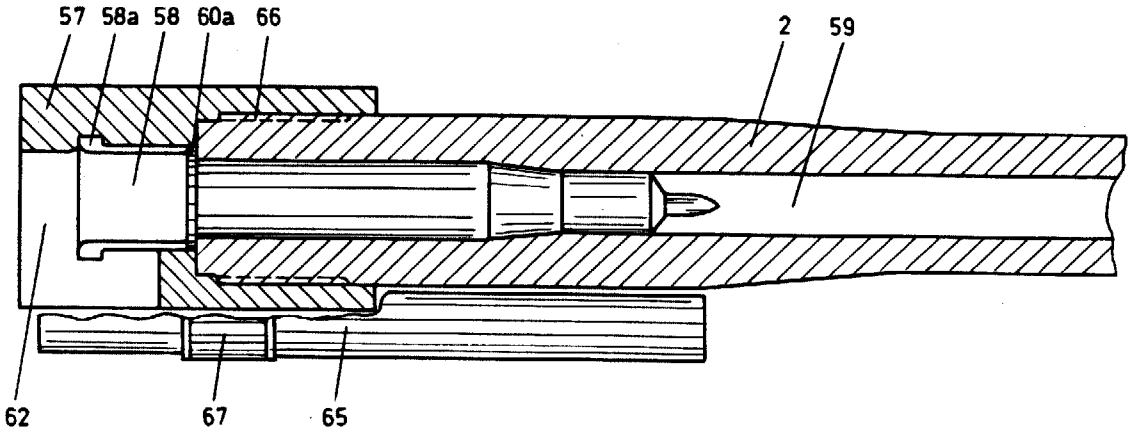
FIGS. 11*a*–11*c* shows different views of the parts concerned of the firearm with breech ring of a first embodiment.
Figure 11C:
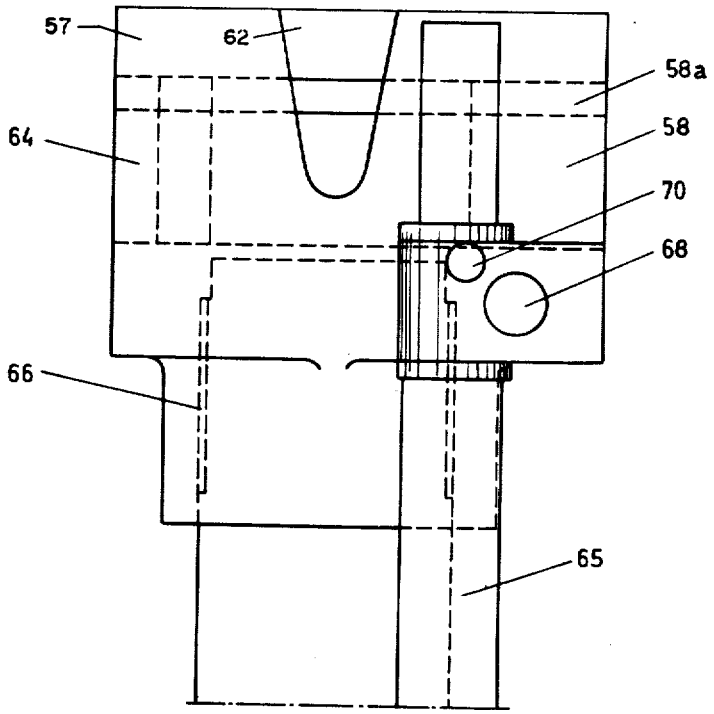
Figure 11B:
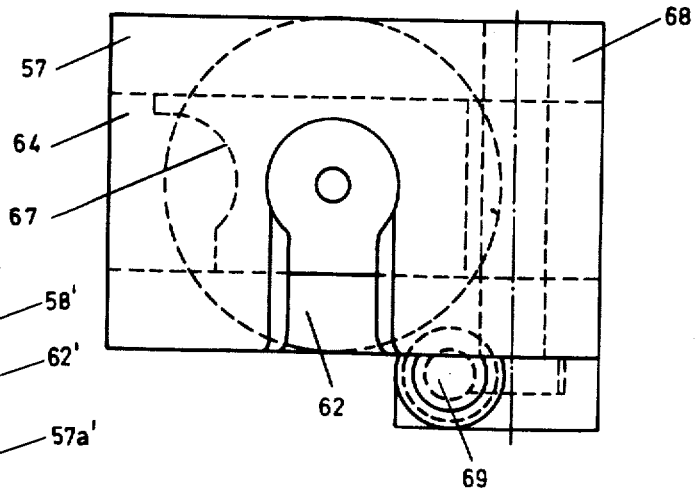

FIGS. 11*a*–11*c* show a design of a firearm with a breech ring according to the invention. FIG. 58*a* shows the breech ring in a vertical view and in cross section, and also shows a round inserted in the bore 59 and the breech block 58 in its closed position, where it is in contact with the rear flange 60*a* of the round. The barrel is fastened to the breech ring 57 by means of threads 66. The semi-automatic device 65 has a fastening member 67 by means of which it is attached to the breech ring. As will be noted from Figure at 58*a*, the recess 62 has a rectangular or square cross section in the vertical plane through the center axis of the breech ring (the plane shown in the figure).

FIG. 11*b* is a view from the rear, and FIG. 11*c* is a view from below, of the breech ring according to FIG. 11*a*. In FIG. 11*b*, the recess in the breech block is designated 67, which recess in the section in question has the form of a keyhole half, which in the opened position of the breech block conforms to the recess 62, so that this recess will be open downwards when the breech block is in its open position. The breech block, which in FIG. 11*b* is shown in its closed position, is operated by means of the operating shaft 68 comprised in the mechanism, which shaft at one end has a gear wheel and in its center part supports an operating lever not shown, for actuating the breech block. The movement to the operating shaft is transmitted from the semi-automatic device, which is known in itself, by means of a gear rack 69. In the figure, an extractor axle 70 is also indicated.

In the example of the embodiment, the breech block can be operated towards the right. The reason for this positioning is that, in accordance with FIG. 9, it is desired to mount the weapon assymmetrically on the tank so that the barrel will be parallel to the center line of the tank in the longitudinal direction. As the breech ring is moreover mounted at the rear part of the tank, particularly at the rear quarter section of the tank, the space for the movement of the breech block will be in the right rear corner of the tank, which has the result that the remaining space can better be used for the crew and the ammunition.

The groove 64 for the breech block can instead be made vertically, and the recess 62 can be allowed to emerge at one side surface of the breech ring, so that the round can be inserted in the breech ring from one side, instead of from below. Alternatively, the recess can then be made so that it emerges at both side surfaces of the breech ring, whereby the round in question can be inserted from either side, as desired, which is of importance when alternating the kind of ammunition used.

Figure 12:
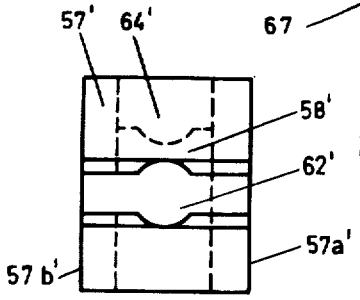
FIG. 12 shows in an end view a breech ring of a second embodiment.

FIG. 12 is intended to show, in principle, an end view that corresponds to the end view 11*b* of a breech ring which is made with a vertical groove 64' for the breech block 58', which can then be displaced vertically. The recess then emerges at the rear surface of the breech ring, as well as its two side surfaces 57*a'* and 57*b'*, whereby the round can be inserted from any side desired. In the figure, the breech block is shown in its closed position, and therefore the extraction direction of the breech block will be downwards in the figure. The breech ring can, of course, be made so that its breech block will have a movement directed upwards at the extraction.

The embodiment according to FIG. 12 is particularly suitable for use when the space available when loading is narrow vertically. The invention is not limited to the embodiment shown above as an example, but can be subject to modifications within the scope of the following claims.

I claim:

1. Apparatus for the loading of rounds of ammunition from at least one magazine into the barrel of a firearm which is movable in elevation about a first axis comprising:

first means rotatable about a second axis parallel to said first axis and also movable translationally along said second axis, second means for rotating said first means between first and second angular positions about said second axis, third means for translationally moving said first means along said second axis between at least first and second spaced locations, fourth means effective only when said first means is in its first said angular position and in its first said spaced location along said second axis to transfer a round of ammunition from the magazine to said first means, and fifth means effective when said first means is in its second angular position and in its said second spaced location along said second axis to transfer the round of ammunition from said first means to the barrel of the firearm.

2. The apparatus of claims 1 wherein said first means is movable translationally also to a third predetermined spaced location along said second axis, and means effective when said first means is in its said first angular position and in its said third spaced location to transfer a round from a further magazine to said first means.

3. The apparatus of claim 1 wherein said first means supports a round of ammunition after withdrawal thereof from said magazine with its forward projectile end farthest from said second axis.

4. The apparatus of claim 1 wherein said second means rotates said first means to its second angular position only when said first means is in its said second translational position along said second axis.

5. The apparatus of claim 1 in which said first means is rotatably supported on a shaft, and shaft bearing brackets support said shaft for longitudinal movement relative to said shaft, and an angle arm engaging said shaft via a longitudinal slot in said shaft for rotating said shaft.

6. The apparatus of claim 2 which further includes a pair of cartridge case deflectors operatively connected to said first means in such manner that a first of said deflectors is aligned with the axis of said barrel when said first means is in its said first spaced location along said second axis and the other of said deflectors is aligned with the axis of said barrel when said first means is in its said second spaced location along said second axis.

7. The apparatus of claim 1 wherein said magazine stores ammunition rounds in vertical columns and means operatively connected to said first means transfers successive rounds from said magazine one at a time from the bottom of the column of rounds.

8. The apparatus of claim 1 wherein said magazine stores rounds in vertical columns and means operatively connected to said first means transfers successive rounds from said magazine one at a time from the top of the column, said apparatus further including means for moving upwardly the column of rounds each time that a round is withdrawn from the top of the column.

9. The apparatus of claim 1 which further includes means operatively supported on said first means for ramming a round into the breach of the gun barrel.

* * * * *